United States Patent [19]

Carlson

[11] Patent Number: 4,890,101

[45] **Date of Patent: * Dec. 26, 1989**

[54] APPARATUS FOR ADDRESSING ACTIVE DISPLAYS

[75] Inventor: Allan I. Carlson, Briarcliff Manor, N.Y.

[73] Assignee: North American Philips Corporation, New York, N.Y.

[ * ] Notice: The portion of the term of this patent subsequent to Dec. 26, 2006 has been disclaimed.

[21] Appl. No.: 283,355

[22] Filed: Dec. 12, 1988

Related U.S. Application Data

[63] Continuation of Ser. No. 88,762, Aug. 24, 1987.

[51] Int. Cl.[4] ..... G09G 3/20

[52] U.S. Cl. ..... 340/811; 340/719

[58] Field of Search ..... 340/718, 719, 783, 784, 340/811; 350/332, 333; 358/230, 236, 240, 241, 56, 59; 315/169.1, 169.3, 169.4

[56] References Cited

U.S. PATENT DOCUMENTS

| | | | |
|---|---|---|---|
| 3,862,360 | 1/1975 | Dill et al. | 340/784 |
| 4,110,662 | 8/1978 | Greeneich et al. | 340/719 |
| 4,429,305 | 1/1984 | Hosokawa et al. | 340/784 |

*Primary Examiner*—David K. Moore
*Assistant Examiner*—Jeffery A. Brier
*Attorney, Agent, or Firm*—Algy Tamoshunas; Marianne R. Rich

[57] ABSTRACT

An input circuit to an active addressed display sequentially switches pixels of video information into high speed sample-and-hold elements which are coupled to corresponding signal lines on the substrate. The pixels of video information are on the signal lines for a complete switching cycle and are transferred to vertical source lines of the display during a time interval equal to the period of a switching cycle.

8 Claims, 3 Drawing Sheets

APPARATUS FOR ADDRESSING ACTIVE DISPLAYS

This is a continuation of application Ser. No. 088,762, Aug. 24, 1987.

BACKGROUND OF THE INVENTION

1. Field of the Invention

The invention pertains to the field of active addressed displays, and more particularly to addressing circuitry which permits relatively long switching times for vertical source line switches, permitting the use of relatively small TFT's on the display substrate for this switching.

2. Description of the Prior Art

Active addressed TV displays normally employ a plurality of display units, each of which may be a liquid crystal cell, arranged in a matrix of N horizontal rows and M vertical columns. The display units are addressed by an addressing circuit which sequentially samples a video scan line to store pixels of video information in storage capacitors associated with source lines coupled to the display elements in the M vertical columns. Source line switches coupled to the source line storage elements are cycled by a horizontal switch activating generator, normally a shift register having M stages. The source line switches are turned on and off sequentially to transfer the pixel information to storage elements connected to the source lines of the display. The switching time required for pixel information storage is equal to 1/M times the horizontal scan time. At the conclusion of a horizontal scan, a vertical switch activating generator, normally a shift register of N stages, simultaneously activates a row of switches corresponding to the horizontal scan line to transfer the stored pixel information to a row of display elements. Thus, each row of pixel switching elements is cycled once during a frame interval, and every display element is addressed during a frame period.

The time available to charge a vertical source line storage capacitor, as indicated above, is determined by the horizontal scan time divided by the number of pixel elements along the horizontal scan line. The switching time is about 100 nanoseconds for the standard NTSC line scan time and 640 pixel (resolution) elements along a scan line.

In order to reduce the size and cost of active address displays, it is desirable to integrate the addressing circuitry onto the substrate of the display using the same type of thin film transistors that are used to transfer the pixel information into the display elements. This arrangement greatly reduces the number of interconnections that are required when the addressing circuitry is located external to the substrate containing the display elements. Thin film transistors have low charge carrier mobility and consequently have high ON resistance for a given transistor area, thereby establishing long time constants for charging the storage capacitors. In the matrix arrangement of an active addressed array, thin film transistors capable of transferring the required charge into the source line storage capacitors in 100 nanoseconds or less would need a high channel width to length ratio and therefore would occupy a relatively large area on the substrate. These large area transistors also exhibit low production yields and relatively low operational reliability.

It is therefore an object of this invention to provide an active addressed display utilizing small, relatively long switching time, thin film transistors integrated on the display substrate while providing a video display without degradation.

SUMMARY OF THE INVENTION

In accordance with the principles of the present invention, a plurality of signal lines located on the substrate of an active addressed display are correspondingly coupled to an equal number of sample-and-hold circuits located off the substrate. These sample-and-hold circuits can be made from single crystal material to optimize switching time. The sample-and-hold circuits sequentially sample a video signal at a rate which stores one pixel of video information in each sample-and-hold circuit. A stored pixel of video information is held on the signal line corresponding to the sample-and-hold circuit wherein it is stored for a time equal to the sampling time of the sample-and-hold circuit times the number of such circuits utilized. This permits the transfer of the pixel of information to a vertical source line storage capacitor over a time period equal to the number of signal lines on the substrate multiplied by the sampling time of the sample-and-hold circuits.

Each signal line is coupled by source line switches to a number of vertical source line storage capacitors. The number of these capacitors per signal line is determined by dividing the number of pixels in a video scan line by the number of signal lines. The signal lines are sequentially energized by the sample-and-hold circuits and remain energized for a complete cycle of the sample-and-hold circuits. After the first cycle has been completed, the first storage capacitors on each signal line are charged with pixel information. The sample-and-hold circuit is then recycled and pixels of video information are stored in the second storage capacitors coupled to the signal lines in a like manner. This process continues until pixels of video information of a completed scan line are stored. At this time, the signals stored in the vertical source line storage capacitors are simultaneously coupled to the display elements corresponding to the stored horizontal video scan line.

In a second embodiment of the invention several source line switches are activated simultaneously by a single output pulse from a horizontal switch activation generator, or shift register. An even number, h, of sample-and-hold circuits are used to hold the pixel information on a corresponding number of signal lines. These sample-and-hold circuits and signal lines are divided into two equal groups. Gates of a first group of source line switches are coupled to a first output stage of the shift register. This first group of source line switches is coupled to transfer pixel information on the first group of signal lines onto a first group of source lines. Gates of a second group of source line switches are coupled to a second output stage of the shift register. This second group of source line switches is coupled to transfer pixel information on the second group of signal lines onto a second group of source lines. Gates of a third group of source line switches are coupled to a third output stage of the shift register. This third group of switches is coupled to transfer pixel information from the first group of signal lines onto a third group of source lines. This organization of source line switches is repeated until all the source line switches are coupled to output stages of the shift register in groups of switches. Odd numbered groups of source line switches transfer pixel information from the first group of h/2 signal lines onto odd numbered groups of source lines while the even numbered groups of source line switches transfer pixel information from the second group of signal lines to the even numbered groups of source lines. Other groupings for the signal lines and the source line switches are also possible that permit relatively long switching times for the vertical source line switches.

In operation, the pixel information is sequentially switched onto the signal lines as in the first embodiment. After the pixel information is put on the first group of signal lines, the first group of source line switches is turned on to transfer the pixel information onto the first group of source lines. During this transfer period, pixel information is sequentially switched onto the second group of signal lines. After the pixel information is put on the second group of signal lines, the second group of source line switches is turned on to transfer the pixel information onto the second group of source lines. During this period, new pixel information is put on the first group of signal lines. This process is repeated until a line of video information is transferred into the source line storage capacitors. The gate line corresponding to the video scan line is then turned on to simultaneously transfer the pixel information into the display elements as in the first embodiment. This switching arrangement allows a slower shift register with fewer stages to be used to activate the source line switches. The smaller number of connections between the shift register and the source line switches make it practical to locate the shift register off the substrate of the display and still have relatively few interconnections between the drive electronics and the substrate of the display.

In another embodiment of the invention, a row of pixel element switches is turned on when sampling of the corresponding scan line of video information starts. This allows the pixel information to be transferred directly from the sample-and-hold devices into the pixel elements along the row, thus eliminating the need for source line storage capacitors.

In still another embodiment of the invention high input impedance buffer amplifiers are coupled between the sample-and-hold storage capacitors and the signal lines. This permits smaller capacitors in the sample-and-hold circuits without degrading sampling performance. In this case, the current required to address the array may be supplied by the power supply of the buffer amplifiers.

DESCRIPTION OF THE PREFERRED EMBODIMENTS

Figure 1:
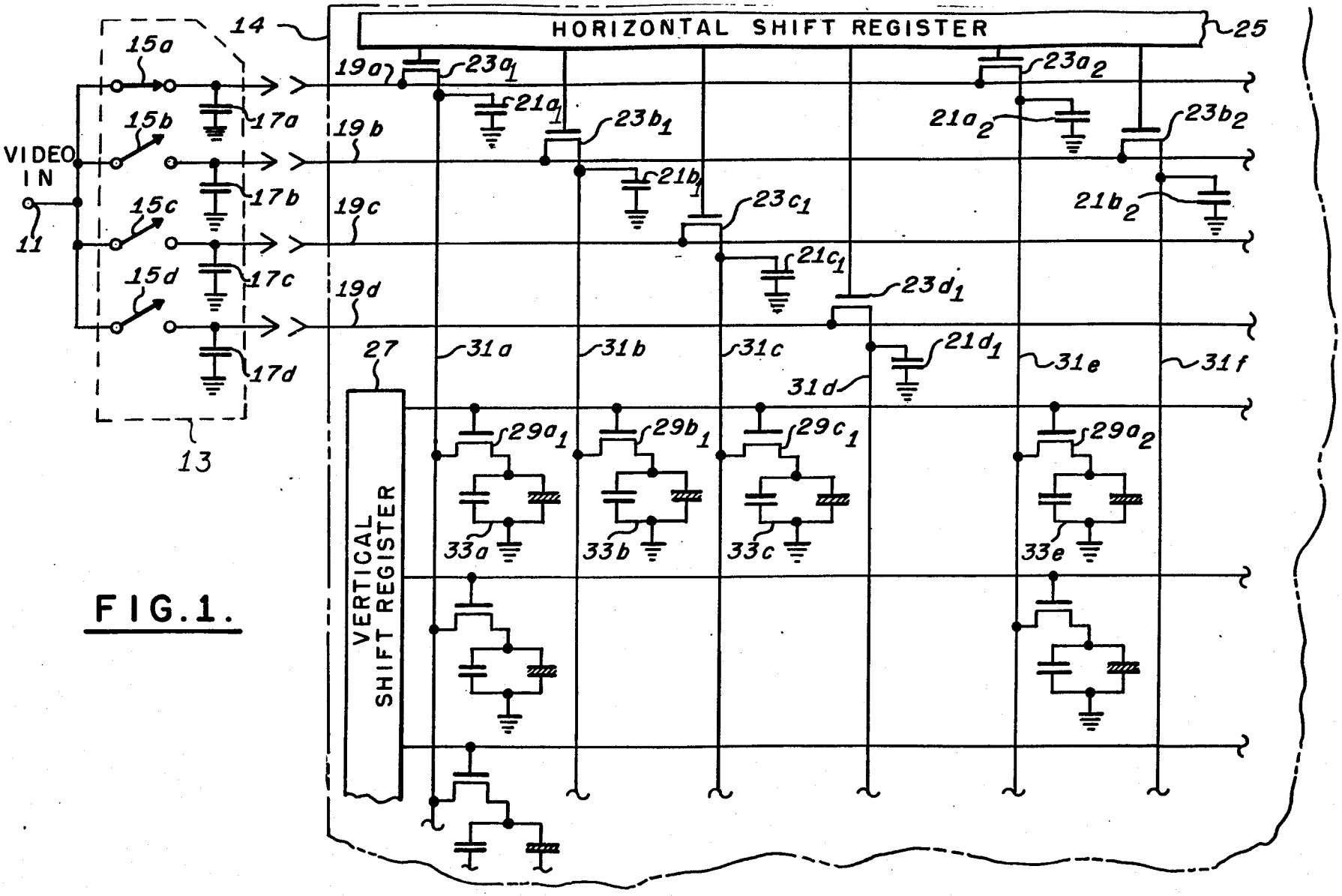
FIGS. 1–3 are schematic diagrams of preferred embodiments of the invention.

Referring to FIG. 1, a video scan line is coupled to a video input terminal 11 of a sample-and-hold circuit 13. To meet switching speed and current carrying requirements, this circuit may be made from a single crystal material positioned off the substrate 14 containing the display elements. For purposes of explanation, the sample-and-hold circuit 13 is shown as a combination of conventional switches 15*a*–15*d* correspondingly coupled to storage capacitors 17*a*–17*d*. The output terminals of the sample-and-hold circuit 13 are correspondingly coupled to signal lines 19*a*–19*d* on the substrate 14. Video scan lines coupled to the input terminal 11 are sampled by sequentially turning switches 15*a*–15*d* on and off to couple corresponding storage capacitors 17*a*–17*d* to the input terminal 11. The switching rate is adjusted to couple each storage capacitor to the input terminal for a time duration that is sufficient to store one pixel of video information. After a capacitor has been charged, the signal representative of pixel information remains on the corresponding signal line until the switch coupling that storage capacitor to the input terminal 11 is recycled. Thus, if the switching time is of duration $t_1$, the representative signal is held on the signal line for a time $t_2=n\times t_1$, where n is the number of signal lines on the substrate, which for the example shown in the figure is equal to 4.

Each signal line 19*a*–19*d* is coupled to a multiplicity of vertical source line storage capacitors through coupling switches, as for example, storage capacitors $\mathbf{21}a_1$ and $\mathbf{21}a_2$ coupled to signal line 19*a* through switches $\mathbf{23}a_1$ and $\mathbf{23}a_2$. A switch activating circuit 25, which may for example be a shift register, is synchronized to activate the switches $\mathbf{23}a_1$ through $\mathbf{23}d_1$ sequentially to transfer the pixels of video information on the signal lines 19*a* through 19*d* to the vertical source line storage capacitors $\mathbf{21}a_1$ through $\mathbf{21}d_1$. Since this transfer may be accomplished over the time interval $t_2=n\times t_1$, the switches $\mathbf{23}a_1$ through $\mathbf{23}d_1$ on the substrate 14 may be of a slow. action type, such as thin film transistors occupying relatively small areas on the substrate. After the first set of n pixels of video information have been coupled to the signal lines, 19*a*–19*d*, sample-and-hold circuit 13 is recycled, the set of switches $\mathbf{23}a_1$–$\mathbf{23}d_1$ are deactivated sequentially and the process is continued with the sequential activation of the next set of thin film transistor switches to couple the subsequent set of pixels of video information to the next set of vertical source line capacitors. In the figure, only the switches $\mathbf{23}a_2$ and $\mathbf{23}b_2$ with the associated vertical source line storage capacitors $\mathbf{21}a_2$ and $\mathbf{21}b_2$ of the subsequent switch and capacitor sets are shown. The process is continued until all the vertical source line storage capacitors, which comprise m sets of n such capacitors to complete one video scan line, are all charged with pixels of video information.

When all the vertical source line storage capacitors have been charged, a vertical pulse generator 27 activates a row of $m\times n=M$ transfer switches, four of which $\mathbf{29}a_1$, $\mathbf{29}b_1$, $\mathbf{29}c_1$ and $\mathbf{29}a_2$ are shown in the figure, to permit the transfer of the stored pixels of video information from the storage capacitors 21 via M vertical source lines, six of which 31*a*–31*f* are shown in the figure, to the row of M display elements, four of which 33*a*, 33*b*, 33*c*, and 3*e* are shown. This process is repeated for each video scan line.

Figure 2:
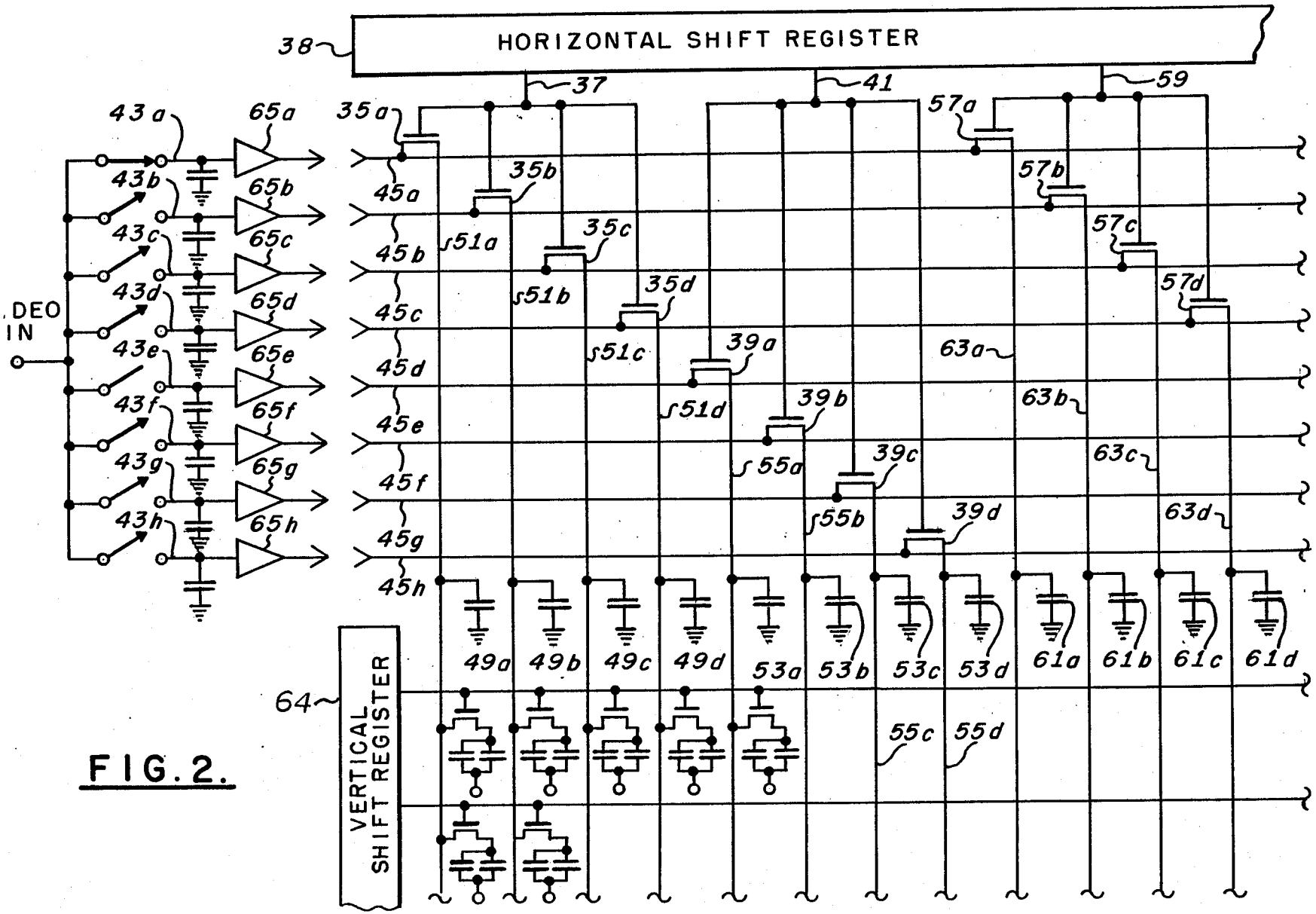

The invention has been described with sequential switching of the individual sample-and-hold circuits. Several variations are possible. One such variation is shown in FIG. 2. A multiplicity of source line switches are grouped and activated simultaneously by a single output pulse from a horizontal switch activation circuit, as for example, the group 35*a* through 35*d* simultaneously activated by a pulse on line 37 coupled from shift register 38 and the group 39*a* through 39*d* simultaneously activated by a pulse on the line 41 coupled from shift register 38. An even number of sample-and-hold circuits are used to hold the pixel information on the same number of signal lines. In FIG. 2 eight such sample-and-hold circuits 43*a* through 43*h* are shown coupled to eight corresponding signal lines 45*a* through 45*h*. The gates of the first h/2 source line switches, 35*a* through 35*d* in FIG. 2, are coupled to the first output stage of the shift register 38. This first group of source line switches 35*a* through 35*d* couples the pixel information, in a first group of four signal samples obtained by sample-and-hold circuits 43*a* through 43*d*, on signal lines 45*a* through 45*d* to a first group of source line storage capacitors 49*a* through 49*d* via source lines 51*a* through 51*d*. The gates of the second group of source line switches 39*a* through 39*d* are coupled to a second output stage of the shift register 38. This second group of source line switches couples the pixel information, in a second group of four signal samples obtained by sample-and-hold circuits 43*e* through 43*h*, on the second group of signal lines 45*e* through 45*h* to a second group of storage capacitors 53*a* through 53*d* via a second group of source lines 55*a* through 55*d*.

A third group of source line switches 57*a* through 57*d* are activated by a pulse on line 59 coupled from a third stage of shift register 38. This third group of source line switches transfer pixel information, in a third group of four signal samples obtained by the sample-and-hold circuits 43*a* through 43*d*, to the source line capacitors 61*a* through 61*d* via source lines 63*a* through 63*d*. A fourth group of source line switches, not shown, are activated by a fourth stage of shift register 38, to couple a fourth group of four signal samples obtained from the second group of sample-and-hold circuits 43*e* through 43*h*, to a fourth group of source line capacitors. Grouping of source line switches coupled to a stage of the shift register, source lines, and source line storage capacitors is repeated until all the source line storage capacitors are coupled to the sample-and-hold circuits. In this arrangement the odd numbered groups of source line switches transfer the pixel information from the first h/2 signal lines onto the odd numbered groups of source lines, while the even numbered groups of source line switches transfer the pixel information from the second group of h/2 signal lines onto the even numbered groups of source lines. Other groupings of the signal lines and source line switches are possible that permit relatively long switching times for the vertical source line switches.

In operation, the pixel information is switched onto the signal lines in a manner similar to that previously described. After the pixel information is put on the first group of signal lines, the first group of source line switches is turned on to transfer the pixel information onto the first group of source lines. During this transfer period, pixel information is sequentially coupled from the sample-and-hold circuits to the second group of signal lines. After pixel information is put on a second group of signal lines, the second group of source line switches is turned on to transfer the pixel information onto the second group of source lines. During this second period, new pixel information is put on the first group of signal lines. When this new pixel information is on the first group of signal lines, the third group of source line switches is turned on to transfer the pixel information onto the third group of source lines. This process is repeated until a scan line of video information is transferred into the source line storage capacitors for that scan line. At that time, the gate line corresponding to that video scan line is turned on by a pulse from a vertical switch activation circuit, such as vertical shift register 64, to simultaneously transfer the pixel information into the display elements as previously described. In this manner, a slow shift register with fewer stages can be utilized to activate the source line switches. Since fewer connections are required between this shift register and the source line switches, it is practical to locate the shift register off the substrate of the display and still have relatively few interconnections between the drive electronics and the substrate.

Referring again to FIG. 2, high input impedance buffer amplifiers 65*a* through 65*h* may be correspondingly coupled between sample-and-hold circuits 43*a* through 43*h* and the signal line 45*a* through 45*h*. These buffer amplifiers permit the sample-and-hold circuits to have smaller hold capacitors and still provide adequate sampling of the input video signal. Since the buffer amplifiers require a power supply, the current required to address the array maybe drawn therefrom.

An economy of circuit elements may be realized in the operation of the invention by turning on a row of pixel element switches at the same time that the corresponding scan line of video information starts to be sampled by the sample-and-hold circuits.

Figure 3:
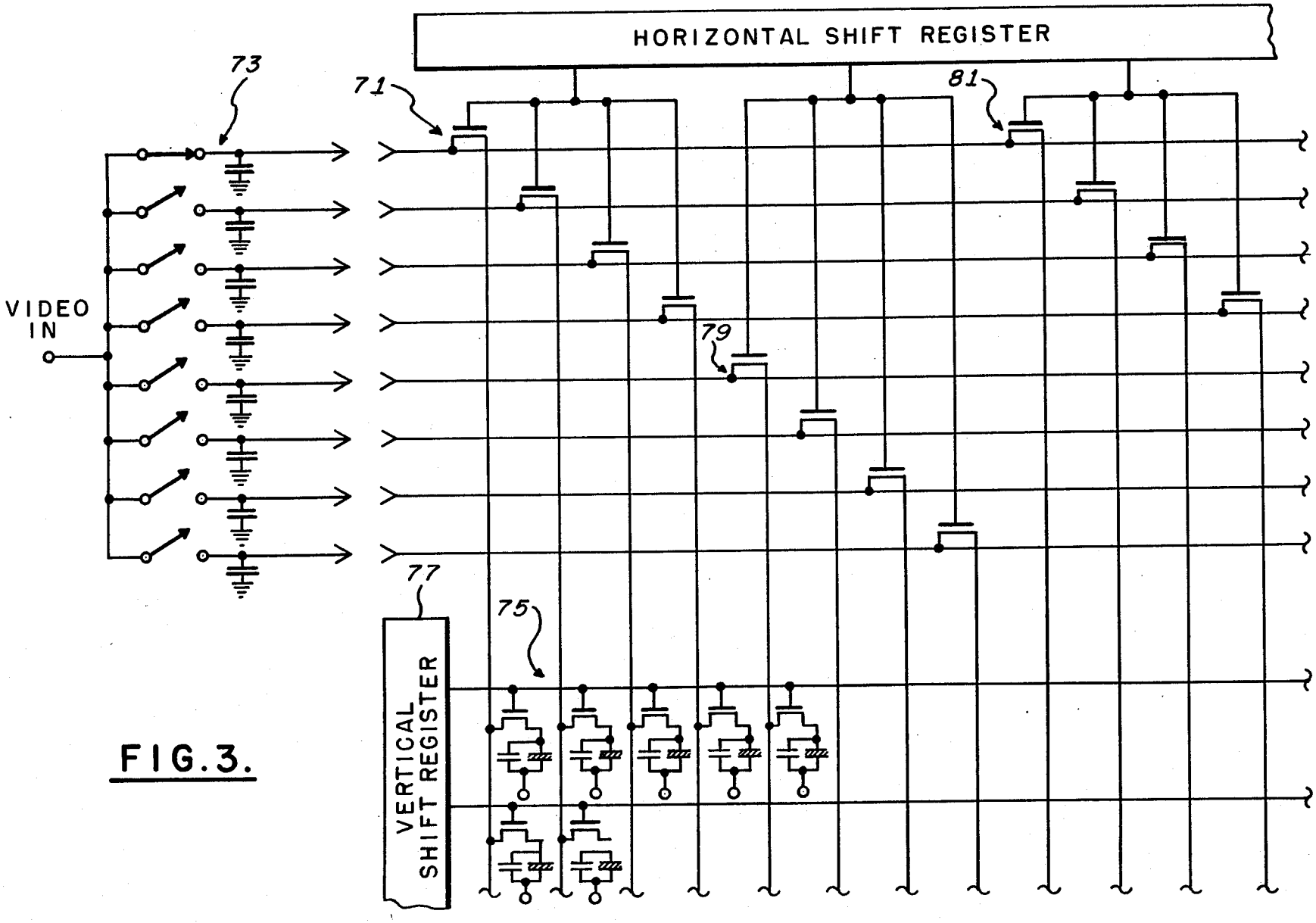

Referring now to FIG. 3, wherein a schematic representation of and embodiment of the invention is shown which permits pixel information to be transferred directly from the sample-and-hold circuits to the pixel elements along a scan row. A first group of source line switches 71 are activated when sample-and-hold circuits 73 commence sampling a scan line of video information. Simultaneously with the activation of the first group of source line switches 71, the entire line of pixel element switches 75, corresponding to the scan line of video information being sampled, are activated by a vertical switch activation circuit, such as vertical shift register 77. Source line switches 71 remain activated until all the pixel information from the corresponding first group of sample-and-hold elements is transferred to the pixel elements. A second group of source lines switches 79 are activated at a time interval after the activation of the first group of source lines 71 that permits a timely transfer of pixel information from the second group of sample-and-hold elements corresponding to the second group of source line switches 79 to the corresponding pixel elements. At a time interval after the second group of source line switches 79 have been activated, a third group of source line switches 81 are activated. The time interval between the activation of the second group and the activation of the third group being equivalent to the time interval between the activation of the first group and the activation of the second group. Activation of the third group of source line switches 81 permits the transfer of pixel information from the first group of sample-and-hold circuits. This sequential activation of groups of source line switches continues until the scan line is completed. This procedure eliminates the need for source line storage capacitors.

While the invention has been described in its preferred embodiment, it is to be understood that the words which have been used are words of description rather than limitation and that changes may be made within the purview of the appended claims without departing from the true scope and spirit of the invention in its broader aspects.

I claim:

1. Apparatus for driving an active addressed display of the type employing display elements arranged in a matrix pattern wherein columns of display elements are coupled to vertical source lines each having an associated storage capacitor, comprising:

n circuits for sampling an input signal to obtain and hold sequentially occurring sampled signals, each signal; obtained over a time interval $t_1$;

n signal lines respectively coupled to said n circuits, each signal line coupled to m vertical source lines, thereby establishing m groups of n vertical source lines respectively coupled to n associated storage capacitors;

means coupled to said n circuits and said n associated storage capacitors in each of said m groups for sequentially transferring sampled signals from said n circuits to said n associated storage capacitors in each of said m groups, each sample signal transfer occurring over a time interval $t_2=(n-1)t_1$ and each group completing a cycle of receiving and transferring said sampled signals to said n associated storage capacitors over a time interval equal to $n \times t_1$; and means coupled to said vertical source lines and said associated storage capacitors for coupling sampled signals stored in said associated storage capacitors to display elements of said matrix pattern.

2. The apparatus of claim 1 wherein said transferring means includes signal line switch means coupled between said n signal lines and said n associated storage capacitors in each of said m groups for sequentially transferring said sampled signals to said n associated storage capacitors in each of said m groups such that each sampled signal is transferred to an associated storage capacitor during said time interval $t_2=(n-1)t_1$.

3. The apparatus of claim 2 wherein said signal line switch means comprises b sets of n/b signal line switches in each of said m groups, where b is an integer, each signal line switch coupled to one of said associated storage capacitors, said b sets of n/b signal line switches being sequentially activated to couple n/b sampled signals to n/b associated storage capacitors simultaneously.

4. The apparatus of claim 3 wherein said n circuits comprise:

n sampling switches, one in each of said n circuits, coupled correspondingly to said signal lines and constructed and arranged for sequentially sampling said input signals such that each provides a signal sample taken over a time duration $t_1$ and samples at $n \times t_1$ intervals; and n sample capacitors, one in each of said n circuits, correspondingly coupled to said sampling switches for storing said signal samples, each sample capacitor providing signal samples to an associated signal line.

5. An apparatus in accordance with claim 4 wherein said display elements, said signal switches and said storage capacitors are on a substrate and said sampling switches in said sample capacitors are external to said substrate.

6. The apparatus of claim 1 wherein said transferring means includes:

activating means having a plurality of output terminals for providing a sequence of activating signals at said output terminals; and a plurality of signal line switches arranged in m groups, n signal line switches to a group and b sets of n/b signal line swithces in each group, b being an integer, said n signal line switches in each group respectively coupled between said n signal lines and said n associated storage capacitors in a corresponding group of associated storage capacitors all switches in a set coupled to one output terminal of said activating means so that sets in a group are sequentially activated and all switches in a group set are activated simultaneously by an activating signal at said one output terminal.

7. The apparatus of claim 1 further including buffer amplifier means coupled between said sampling means and said transferring means.

8. Apparatus for driving an active addressed display of the type employing display elements arranged in a matrix pattern wherein columns of display elements are coupled to vertical source lines comprising:

n circuits for sampling an input signal to obtain and hold sequentially occurring sampled signals, each sampled signal obtained over a time interval $t_1$, thereby establishing a cycle for obtaining n sampled signals equal to $n \times t_1$;

n signal lines respectively coupled to said n circuits and each coupled to m vertical source lines thereby establishing m groups of n vertical source lines and associated display elements;

activating means having a plurality of output terminals for providing a sequence of activating signals at said output terminals;

a plurality of signal line switches each coupled between one of said n signal lines and one vertical source line in each group, said plurality of signal line switches arranged to form b sets of n/b signal line switches and b sets of source lines within each group, n and b being integers with b having a value of at least two, all switches in a set coupled to one output terminal of said activating means so that all switches in a set are simultaneously activated and sets within a group are sequentially activated by activating signals at said output terminals so that said b sets of source lines in each of said m groups of source lines and associated display elements are sequentially coupled to respective signal lines and all source lines and associated display elements within a set being simultaneously coupled to respective signal lines.

* * * * *